United States Patent [19]

Urani

[11] Patent Number: 4,472,018

[45] Date of Patent: Sep. 18, 1984

[54] FUSE CLIP WITH ENCLOSED WIRE CONNECTION

[75] Inventor: Angelo Urani, St. Louis, Mo.

[73] Assignee: McGraw-Edison Company, Rolling Meadows, Ill.

[21] Appl. No.: 467,098

[22] Filed: Feb. 16, 1983

[51] Int. Cl.[3] ..... H01R 11/22

[52] U.S. Cl. ..... 339/259 F; 339/258 F; 339/272 R

[58] Field of Search ..... 339/258 F, 259 F, 272, 339/252 F, 253 F, 262 F, 265 F, 266 F, 270 F

[56] References Cited

U.S. PATENT DOCUMENTS

| | | | |
|---|---|---|---|
| 1,204,691 | 11/1916 | Sacks . | |
| 1,536,149 | 5/1925 | Schmid | 339/262 F |
| 1,902,804 | 3/1933 | La Mar . | |
| 1,945,393 | 1/1934 | Chapman | 339/265 F |
| 2,041,613 | 5/1936 | Lincks | 339/265 F |
| 2,229,989 | 1/1941 | Roby | 200/134 |
| 2,435,794 | 2/1948 | Nicolazzo | 200/133 |
| 2,738,486 | 3/1956 | Wadsworth | 339/258 |
| 2,783,331 | 2/1957 | Sundt | 200/121 |
| 2,942,228 | 6/1960 | Swick | 339/150 |
| 3,076,953 | 2/1963 | Sloop | 339/259 F |
| 3,419,839 | 12/1968 | Mathews | 337/188 |
| 3,492,628 | 1/1970 | Mathews | 339/17 |
| 3,538,492 | 11/1970 | Genovese | 339/258 |
| 4,128,291 | 12/1978 | Peterson | 339/258 F |

FOREIGN PATENT DOCUMENTS

| | | | |
|---|---|---|---|
| 1151847 | 8/1954 | Fed. Rep. of Germany | 339/258 F |
| 1059068 | 6/1959 | Fed. Rep. of Germany | 339/259 F |
| 203427 | 9/1923 | United Kingdom . | |
| 750332 | 6/1956 | United Kingdom . | |

*Primary Examiner*—Joseph H. McGlynn
*Assistant Examiner*—David L. Pirlot
*Attorney, Agent, or Firm*—Charles W. MacKinnon; Jon C. Gealow; John S. Paniaquas

[57] ABSTRACT

A fuse clip comprises a U-shaped retaining member and a U-shaped clamp member. The retaining member has a base and spaced convex walls for supporting one end of a ferrule-type fuse, parallel slots being provided in the base. The clamp member has an end wall and spaced side walls with mounting tabs at the ends of the side walls which pass through the slots in the base of the retaining member. The clip is attached to a mounting member by inserting the tabs through slots in the mounting member and folding the tabs. A clamp screw in the end wall of the clamp member secures a wire conductor in place in direct contact with the retaining member. A spring helper clip may be utilized to bias the convex walls of the retaining member into secure engagement with the fuse.

6 Claims, 6 Drawing Figures

FUSE CLIP WITH ENCLOSED WIRE CONNECTION

BACKGROUND OF THE INVENTION

This invention relates to improved fuse holders and more particularly to fuse clips for use in fuse holders adapted for retaining fuses having ferrule terminals.

Fuses in electrical circuits are designed to provide protection in the event of an overcurrent in the circuits resulting from an unintended lowering of the circuit impedance. Under normal operation the fuse and its associated holder should present a relatively small impedance so that the voltage drop across the fuse and its holder is minimal and has effectively no influence on the circuit being protected. Furthermore, the heat buildup in the fuse and its associated holder must be minimized.

Conventional fuse holders and their associated fuse clips generally include terminal tangs extending from the fuse clips for connection to wires of the circuit to be protected. Examples of these prior art fuse holder designs are disclosed in U.S. Pat. No. 737,407 to Downes, U.S. Pat. No. 2,740,735 to Swain, and U.S. Pat. No. 3,419,839 to Matthews. These patents disclose attaching the clips to mounting members by means of screws or rivets. Other mounting means for conventional fuse clips are disclosed in U.S. Pat. No. 2,229,989 to Roby, U.S. Pat. No. 2,738,486 to Woodsworth, U.S. Pat. No. 2,783,331 to Sundt, U.S. Pat. No. 2,942,228 to Swick, and U.S. Pat. No. 3,492,628 to Matthews. In these, crimped connections of the clip to the mounting member are disclosed. The disadvantage of these prior art fuse holders is that the terminal tang increases the space required for mounting the fuse clip and adds to the impedance of the fuse holder.

U.S. Pat. No. 1,204,691 to Sachs, though not using a tang to provide a connection to the fuse clip, teaches a fuse clip mounted by means of a threaded grommet to a mounting block and having the wire connection made in the interior of the fuse clip by means of a clamp plate secured by a screw in the threaded grommet. The grommet is fitted to the mounting block through an opening in the block. The clip is mounted on the upper end of the grommet by means of an opening in the base of the clip. The upper end of the grommet is expanded to slip over the opening in the clip thereby securing the clip to the block.

U.S. Pat. No. 1,902,804 to LaMar discloses a fuse clip having a wire connection interior to the clip. The clip is mounted to the base by means of a bolt through the base and is secured by a nut. Connection of a wire is provided by means of a second nut on the bolt. Conduction from the circuit to the fuse clip is not direct, but is through a series of mechanical connections which serve to increase the contact impedance presented by the fuse holder to the protected circuit.

U.S. Pat. No. 2,435,794 to Niccolazzo discloses a fuse clip mounted by means of a screw and nut to a mounting block. The wire connection to the interior of the fuse clip is by means of the same screw and nut whereby the clip is loosened from the mount whenever a wire is removed or is connected. No means is provided to prevent rotation of the clip during insertion or removal of a wire.

British Pat. No. 203,427 (1923) to Wootton discloses a clip for block-type fuses having a one-piece fuse clip comprising a pair of retaining arms and a stem extending from the retaining arms and terminating in a circuit member. The associated mounting block contains an opening to receive the stem and circuit member. A screw through the bottom of the circuit member entering through an opening in the bottom of the mounting block is provided to secure a wire connection interior to the circuit member. A similar arrangement is disclosed in U.S. Pat. No. 3,538,492 to Genovese. Both the Wootton (British) and Genovese patents require access to both the top and the bottom of the clip to insert or remove connections.

British Pat. No. 750,332 (1956) to Young discloses a clip having convex side arms for retaining a fuse and a pair of stems extending away from the main body and terminating in a circular member. The fuse block is formed such that mounting of the fuse clip is provided by a circular opening in the block, the opening having a channel to accept the stem. A threaded opening is provided in the side wall of the block to align with an opening in the side of the circular member, and a wire connection inserted into the circular member is secured by a screw through the side. Inserting and removing a fuse is accomplished from the top of the fuse clip whereas inserting and removing a wire requires access to the side of the fuse clip.

SUMMARY OF THE INVENTION

The fuse clip of the present invention comprises a U-shaped retaining member having upwardly extending convex side walls for retaining a cartridge fuse, alternatively referred to as a ferrule-type fuse. The base of the retaining member is provided with parallel slotted openings. A downwardly opening U-shaped clamp member includes an end wall and two side walls. Tabs extend from the ends of the side walls, each having a width less than that of the side walls thereby providing shoulders at the end of each of the side walls. The tabs are inserted through the slots in the base of the retaining member and through slots provided in a mounting member, such as a fuse block, and are bent over to secure the fuse clip assembly to the mounting member. An opening defined by the downwardly opening U-shaped clamp member and the base of the retaining member is formed for receiving a wire conductor which is secured in place by a screw in a threaded opening in the end wall of the U-shaped clamp member.

When connected as described herein, the wire conductor is firmly held in contact with the base of the retaining member, and there is only one contact point between the wire conductor and the fuse clip where contact or connection impedance potentially could cause heating or failure. This minimizes the impedance of the fuse holder in the protected circuit and the potential for contact failure. In addition, the present invention eliminates the need for screws, rivets, grommets, etc. to mount the clip to the fuse block or other mounting member. Alignment of the clips is assured by the slots in the mounting member. Also, the amount of material required to fabricate a fuse clip is reduced and assembly is simplified in view of the few parts required compared with prior art clips. Further, the present invention requires access to only one side of the fuse clip for inserting and removing both the fuse and the wire conductors.

In one preferred embodiment of the present invention, a U-shaped spring helper clip enclosing the retaining member is provided. This permits utilization of the materials in the retaining member having optimum electrical conductivity but which normally do not have ideal spring properties. The spring helper clip may be composed of a material having poor electrical conductivity characteristics but ideal spring characteristics to assure proper retention of the fuse.

It is therefore an object of the present invention to provide a fuse clip having simplified assembly and using a minimum of material.

Another object of the present invention is to provide a fuse clip in which the connector screw cannot be operated to affix or loosen a wire conductor while the fuse is in place.

A further object of the present invention is to provide a fuse clip in which both the fuse and the wire conductor can be inserted and removed from one side of the clip.

A still further object of the present invention is to provide a fuse clip having electrical conductivity between the inserted fuse and the retaining member while providing good fuse retention force.

Yet another object of the present invention is to provide a fuse clip in which the connector member serves as the mounting member thereby eliminating the need for mounting screws, rivets, grommets, etc.

Other objects, features and advantages of the present invention will become apparent with reference to the accompanying drawings and description.

DETAILED DESCRIPTION OF THE PREFERRED EMBODIMENT

Figure 1A:
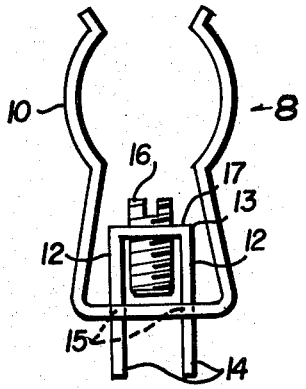
FIG. 1*a* is an end view of one embodiment of the fuse clip of the present invention.
Figure 1B:
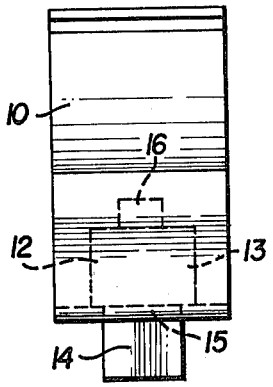
FIG. 1*b* is a side view of the fuse clip of FIG. 1*a;*

Referring in detail to FIGS. 1*a* and 1*b* showing one embodiment of fuse clip 8, fuse-retaining member 10 is a generally U-shaped member having convex side walls conforming to the exterior surface of a fuse ferrule 20. The end view of retaining member 10, as shown in FIG. 1*a,* is a modified form of conventional fuse clip-retaining members in that it does not include a terminal tang.

Parallel slots 15 shown in phantom lines in FIGS. 1*a* and 1*b* are provided in the base of retaining member 10. A generally U-shaped connector and mounting member, referred to herein as a clamp member 13, comprises end wall 17, side walls 12 and tabs 14 which have a shorter lateral width than side walls 12, thus providing shoulders on the side walls at opposite sides of the tabs 14. The clamp member 13 is disposed in the interior of the retaining member 10 with the tabs 14 passing through the slots 15 in the base of the retaining member 10 with the shoulders on the side walls 12 resting on the base of retaining member 10 at opposite ends of the slots 15. A wire connector opening of predetermined size is formed by end wall 17 and side walls 12 of the clamp member 13 and the base of retaining member 10. Clamping screw 16 inserted through a threaded hole in the end wall 17 can be downwardly advanced in the threaded opening to provide clamping action on a bared wire conductor 24 inserted into the connector opening.

Figure 2:
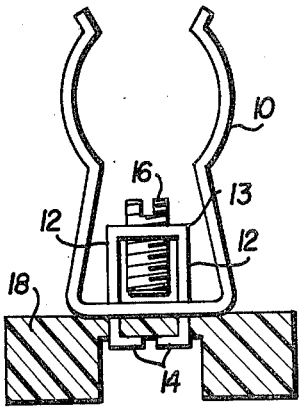
FIG. 2 illustrates, in partial cross-section, the fuse clip of FIGS. 1*a* and 1*b* mounted on a fuse block.

The improved fuse clip 8 is shown mounted on a fuse block 18 in FIG. 2. Tabs 14 pass through slots in block 18 and are folded to provide locking securement of fuse clip 8 to block 18. It should be apparent to one skilled in the art that clip 8 may be attached to circuit boards and other surfaces in this same manner without departing from the spirit of this invention. Further, retaining member 10 can include a stop or abutment, as known in the art, to control lateral movement of a fuse without departing from the present invention.

Figure 3:
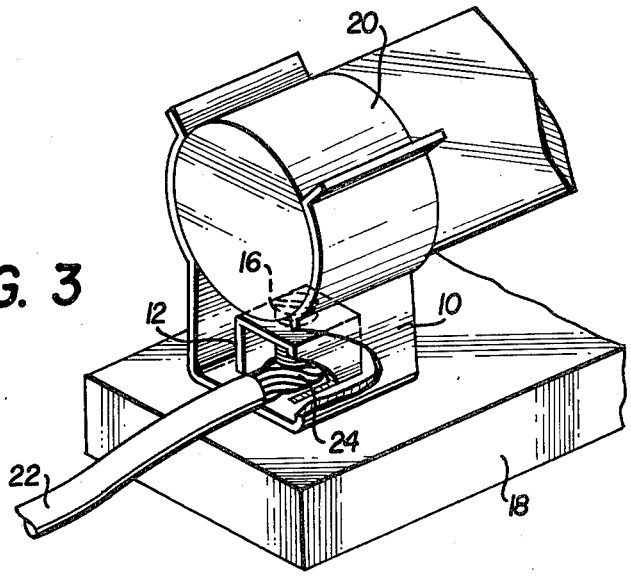
FIG. 3 illustrates the fuse clip, in perspective and partial cut-away, mounted on a fuse block with a fuse and a wire conductor inserted.

FIG. 3 illustrates one end of fuse block 18 including fuse clip 8 of the present invention. Fuse ferrule 20 is shown inserted in retaining member 10. Bared wire conductor 24 of insulated wire 22, which is connected to an electric circuit, is shown securely held in the connector opening formed by the clamp member 13 and the base of retaining member 10 by clamp screw 16. Wire conductor 24 is firmly held in contact with the base of retaining member 10 by pressure from screw 16, thereby providing direct electrical contact between wire conductor 24 and fuse retaining member 10 and insuring low electrical loss and a minimum of associated contact impedance and resistance heating.

Fuse clip 8 of the present invention requires a minimum of lateral mounting space thereby allowing an overall shorter fuse block than permitted in the prior art, provides access to both the fuse and the wire connection from one side of the fuse block, prevents handling of the connector (i.e. screw 16) when the fuse ferrule 20 is in place, and provides for secure locking of clip 8 to the mounting member even when inserting or removing a wire conductor. As can be readily seen by one skilled in the art, the slots for tabs 14 in the mounting member, fuse block 18 in FIG. 3, provide a means to assure alignment of fuse clip 8 and to prevent rotation of the clip.

FIG. 7 depicts a preferred embodiment of the present invention. In general, softer metals such as copper or silver provide better electrical conductivity and lower contact resistance than do the harder metals. However, the harder metals generally have better spring properties. Ideally, the retaining member 10 should have high electrical conductivity for low contact resistance and at the same time have good spring properties to insure secure retention of the fuse. However, these two primary objectives are at odds with each other with respect to the choice of material used in the retaining member. Both objectives can be achieved as shown in the embodiment illustrated in FIG. 4. By disposing the retaining member 10 described hereinabove within a spring helper clip 26, the material used in retaining member 10 can now be chosen with primary regard to conductivity, i.e., a material having high electrical conductivity; and helper clip 26 can be formed from lower conductivity material having the desired spring properties. The material having high electrical conductivity is selected with primary regard to both conductivity and cost effectiveness (e.g., is the added cost of silver warranted or will copper suffice?) and without significant regard to the material's properties as a spring.

Figure 4:
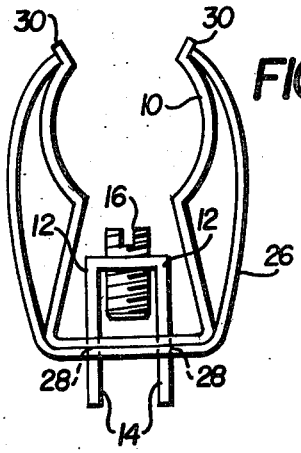
FIG. 4 shows an end view of a preferred embodiment of the present invention.
Figure 5:
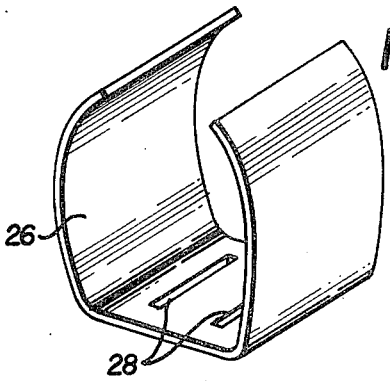
FIG. 5 is a perspective view of the helper clip shown in FIG. 4.

Details of the spring helper clip 26 are shown in FIG. 5. The spring helper clip is a generally U-shaped member provided with parallel slots 28 to receive tabs 14 as shown in FIG. 4. To increase the force applied by the spring helper clip 26, the free ends of the spring helper clip may be arranged to abut tabs 30 at the free ends of the retaining member 10 such that upon insertion of a fuse in the retaining member 10 the free ends of the spring helper clip do not slide on the surfaces of the retaining member. The embodiment of the present invention shown in FIGS. 4 and 5 is of particular utility in high current circuits where the need to minimize heating in the fuse block is critical.

While forms of the fuse clip disclosed herein constitute preferred embodiments, it should be understood that modifications thereof are within the scope and spirit of the invention disclosed and claimed.

What is claimed is:

1. A fuse clip comprising:

(a) a generally U-shaped fuse-retaining member comprising a base and a pair of spaced flexible members extending transversely from said base for securing a fuse there between, said base having a pair of parallel slots;

(b) a generally U-shaped clamp member disposed within said U-shaped retaining member and comprising an end wall and a pair of side walls extending transversely from said end wall and including a tab extending from each of said side walls through said slots in said retaining member for providing securement means to mount said base of said retaining member on a support, said end wall having a threaded opening therein; and (c) a clamping screw in said threaded opening;

(d) said clamping member in cooperation with said base of said retaining member forming a connector opening, said clamping screw being adapted for securing a wire conductor therein against said base of said retaining member.

2. The fuse clip of claim 1 further comprising spring helper means for biasing said pair of spaced flexible members of said retaining member towards each other to secure said fuse therebetween.

3. The fuse clip of claim 2 wherein said retaining member is composed of a material having a higher electrical conductivity than that of the material of said spring helper means.

4. The fuse clip of claim 2 wherein the length of said pair of slots in said base of said retaining member and the width of said tabs of said clamp member are shorter than the width of said side walls of said clamp member whereby shoulders are provided on said side walls which about said base of said retaining member to prevent said side walls from passing through said slots and maintain said end wall of said clamp member at a predetermined distance from said base of said retaining member.

5. The fuse clip of claim 2 wherein said spring helper means comprises a U-shaped spring helper clip comprising a base and a pair of spaced flexible arm members, said retaining member being positioned within said spring helper clip with said bases of said retaining member and spring helper clip abutting and said flexible arm members of said spring helper clip contacting the respective flexible members of said retaining member.

6. The fuse clip of claim 5 wherein said flexible members include transverse projecting elements and the free ends of the respective flexible arm members of said spring helper clip abut said projecting elements.

* * * * *

UNITED STATES PATENT AND TRADEMARK OFFICE

CERTIFICATE OF CORRECTION

PATENT NO. : 4,472,018

DATED : September 18, 1984

INVENTOR(S) : Angelo Urani

It is certified that error appears in the above-identified patent and that said Letters Patent is hereby corrected as shown below:

Column 6, line 16: Change "about" to --abut--.

Signed and Sealed this

*Thirtieth* Day of *April 1985*

[SEAL]

*Attest:*

DONALD J. QUIGG

*Attesting Officer*

*Acting Commissioner of Patents and Trademarks*